United States Patent [19]

Safford

[11] Patent Number: 4,977,624

[45] Date of Patent: Dec. 18, 1990

[54] TIE KNOT

[76] Inventor: Carl A. Safford, 2353 Southern Hills, Mexico, Mo. 65265

[21] Appl. No.: 281,221

[22] Filed: Dec. 8, 1988

[51] Int. Cl.[5] ..... A41D 25/02

[52] U.S. Cl. ..... 2/152 R; 2/153

[58] Field of Search ..... 2/153, 152 R, 152 A, 2/148, 152, 153

[56] References Cited

U.S. PATENT DOCUMENTS

| | | | |
|---|---|---|---|
| 1,086,493 | 2/1914 | Wechsler | 2/150 X |
| 1,830,039 | 11/1931 | Rosicky | 2/150 |
| 1,955,651 | 4/1934 | Parri | 2/150 |
| 2,172,489 | 9/1939 | Peters | 2/150 |
| 2,269,769 | 1/1942 | Kennedy | 2/153 |
| 2,631,292 | 3/1953 | Cunningham | 2/153 |
| 2,787,002 | 4/1957 | de la Piedra | 2/153 |
| 3,146,467 | 9/1964 | Levko | 2/153 |
| 3,755,821 | 9/1973 | Tellone | 2/153 |
| 4,000,523 | 1/1977 | Woods | 2/153 X |

FOREIGN PATENT DOCUMENTS

| | | | |
|---|---|---|---|
| 38133 | 1/1931 | France | 2/150 |
| 1147625 | 6/1957 | France | 2/153 |
| 10941 | 8/1904 | United Kingdom | 2/153 |
| 877229 | 9/1961 | United Kingdom | 2/153 |

*Primary Examiner*—Werner H. Schroeder
*Assistant Examiner*—Jeanette E. Chapman
*Attorney, Agent, or Firm*—Henry W. Cummings

[57] ABSTRACT

A tie knot is provided separate from a conventional tie which eliminates the need for the wearer to tie a knot in the tie. The knot may be of the same color as the tie or be a contrasting color.

8 Claims, 2 Drawing Sheets

TIE KNOT

BACKGROUND OF THE INVENTION

The time and inconvenience necessary to tie a good-looking tie is a significant problem. This problem is accentuated when the wearer is behind schedule and needs to have a good-looking tie quickly in place.

The present invention is directed towards a solution to this problem.

Another problem is the need to avoid wearing the same appearing tie frequently. By utilizing existing ties and contrasting tie knots the problem of over use of individual ties is effectively avoided.

SUMMARY OF THE INVENTION

A tie knot is provided separate from a conventional tie which eliminates the need for the wearer to tie a knot in the tie. The knot may be the same color as the tie or be a contrasting color.

DESCRIPTION OF PREFERRED EMBODIMENTS

Tie knot is made of any material preferably plastic or plastic compound that is firm enough to keep the tie knots shape yet flexible enough to allow it to open out and close around the tie.

It can be made of molding, or die cutting into its shape.

Tie knot can be covered with cloth (matching, complimenting or contrasting the tie itself) or leather (synthetic or genuine) attached by glue, sewing, heat seal or any combination of the above.

Tie knot does not necessarily have to be covered. It can be made of different and varied colors of textured or smooth plastic eliminating the need to cover it, that would match, compliment, or contrast with different tie materials.

Tie knot is lined with a non-slip, slip resistant material that will hold tie knot in place, yet will still allow tie knot to slide up and down the tie itself.

The knot is placed around the tie and closed by snapping the snap or any other locking device and slid upward to the top at the shirt collar locking it in place by sheer non-slipping resistance against the slip resistant lining. The pressure is released when unsnapping the snap and removing. Another way to remove the tie knot is to leave the knot snapped and slide downward off the two end tips of the tie at the bottom.

Tie knot is useful as it simplifies tying a tie by eliminating the need to know how to tie a knot.

Can eliminate second and third attempts at getting tie tied right.

Can be sold individually or as a package (knot and tie together) or knot for any tie at the users discretion.

The tie can be worn open collared (casual) by holding tie knot firmly and pulling downward and then unbuttom collar.

Another advantage of my pre-formed tie knot is that the knot and tie can be contrasting colors or design. For example, a solid color knot with diagonal striped tie or diagonal patterened knot with solid color tie or solid color knot same color and pattern as tie or patterned knot with same patterned tie.

Another advantage is my tie knot makes any length tie longer or shorter by varying the length of the front panel (the wider part of the tie) and the back panel (the narrower part).

Figure 5:
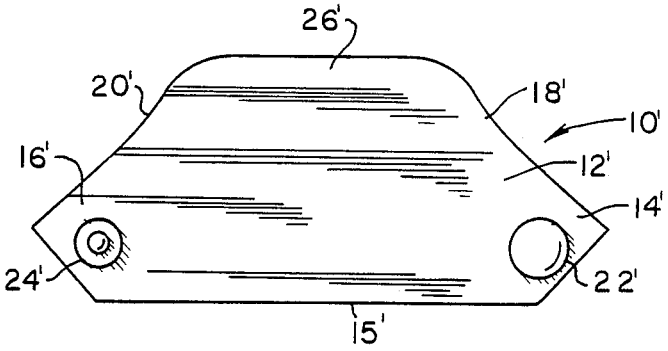
FIG. 5 is a view of another alternate blank illustrating a modification in the shape of the present invention.
Figure 6:
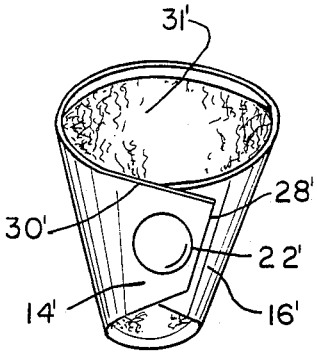
FIG. 6 is a view of the alternate tie knot of the present invention with the snap arrangement in a closed position.

Another advantage of my pre-formed tie knot is that by varying the size and shape of the blank slightly, as in FIGS. 5 and 6 you can change the shape and size of the knot. This slight change in shape of the blank can give you look of the Windsor knot, four-in-hand, or any style knot that is prevalent at the time of manufacture.

The tie member of the present invention is indicated generally at 10. It includes a body portion 12 and extensions from the body portion 14 and 16.

Arcuate curved portions 12 and head portion 26.

A separate tie member T extends through the collar of a shirt, and downwardly through the tie knot.

One extension 14 includes a female snap member 22 and the other extension 16 includes a male snap member 24. Other fastening means such as buttoms, rivets or VELCRO (trademark of VELCRO CORP. OF AMERICA) may be used.

Figure 3:
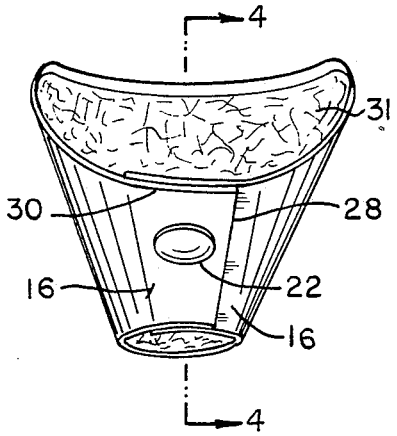
FIG. 3 is a view of the tie knot of the present invention with the snap arrangement in a closed position.

FIG. 3 portion 31 illustrates the application of non-slip material to the internal surface of the tie blank.

Figure 4:
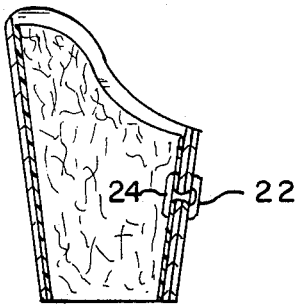
FIG. 4 is a view looking in the direction of the arrows on line 4—4 in FIG. 3.

FIG. 4 illustrates that in the snap position there is an overlap between the extension 28 having the snap member 22 and the extension 30 having the male snap member 24.

Figure 2:
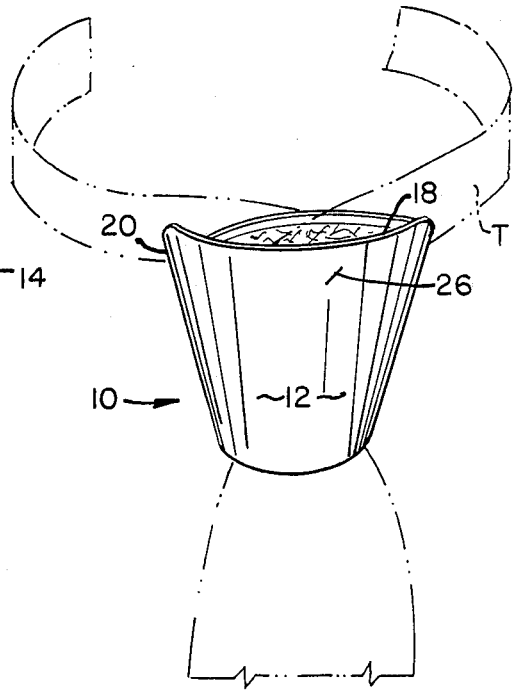
FIG. 2 is a front elevated view illustrating the tie with the present invention in place.

FIG. 2 illustrates the tie member in place. Note that the arcuate portions 18 and 20 define a rear portion of less height that the front portion 26. This enables a tie knot to effectively engage the tie member T extending through the shirt collar so that the tie member is snug and properly in place within the tie knot.

Figure 1:
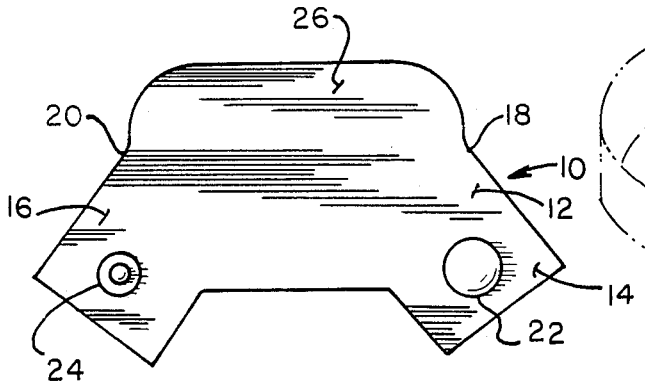
FIG. 1 is a view of the front side of a blank used to form the tie knot of the present invention.

FIGS. 5 and 6 illustrate a modification of the present invention including a tie knot 10' having a body portion 12' and a head portion 26'. Arcuate portions 18' and 20' of reduced extent join head portion 26' to body portion 12'. Extensions 14' and 16' extend downwardly and outwardly from body portion 12', and each has a snap member respectively, 22' and 24'. Slip resistant material 31' is applied to the internal surface 30' of the tie knot 10'. FIG. 6 shows the tie knot 10' in closed position with the fasteners 22' and 24' connected. Portion 15' between extensions 14' and 16' is continuous and is not cut away as in FIG. 1.

What is claimed is:

1. A single tie knot element comprising a tie knot body portion made of a material sufficiently firm to keep a tie knot shape and sufficiently flexible to allow it to open and close around the tie; an upper head portion integral with said body portion, said head portion having a linear top edge; a pair of laterally spaced concave arcuate curved portions joining said head portion to said body portion; and laterally space extensions extending down from said body portion, each extension containing fastening means for holding said extensions together in assembled position and holding said tie knot in engagement with a shirt collar.

2. A tie knot according to claim 1 wherein a lining of slip resistant material is applied to said body portion on the internal surface thereof.

3. A tie knot according to claim 2 wherein said slip resistant material is applied to a portion only of said body portion.

4. A tie knot according to claim 1 wherein said fastening means incude a male snape member on one extension and a female member on the other extension.

5. A tie knot according to claim 1 wherein said knot is made in a contrasting color to said tie.

6. A tie knot according to claim 1 wherein said knot is made of slip resistant material.

7. A tie knot according to claim 1 wherein the head portion extends above the body portion when the tie knot is in place within the collar.

8. A tie knot according to claim 1 wherein said knot and said tie are made of the same color material.

* * * * *